US005893552A

United States Patent [19]

Fraser

[11] Patent Number: 5,893,552

[45] Date of Patent: Apr. 13, 1999

[54] CLAMP

[76] Inventor: Ian Fraser, 16 Newton, Codicote, Hertfordshire, SG4 8UQ, United Kingdom

[21] Appl. No.: 08/787,761

[22] Filed: Jan. 28, 1997

[51] Int. Cl.[6] ..... B25B 5/08

[52] U.S. Cl. ..... 269/236; 269/229

[58] Field of Search ..... 269/236, 216, 269/217, 229, 233, 204, 198, 199, 136, 139, 24

[56] References Cited

U.S. PATENT DOCUMENTS

| | | | |
|---|---|---|---|
| 345,636 | 7/1886 | Hunter | 269/236 |
| 889,842 | 6/1908 | Arnold | 269/236 |
| 2,153,998 | 4/1939 | Verderber et al. | 269/236 |
| 2,236,439 | 3/1941 | McKenna | 269/229 |
| 2,815,052 | 12/1957 | Krasnow | 269/236 |
| 3,159,393 | 12/1964 | Villano | 269/236 |
| 4,475,726 | 10/1984 | Smith | 269/236 |
| 5,005,813 | 4/1991 | Lawrence | 269/236 |

FOREIGN PATENT DOCUMENTS

| | | |
|---|---|---|
| 24890/67 | 1/1970 | Australia . |
| 385287 | 3/1931 | United Kingdom . |
| 744064 | 2/1956 | United Kingdom . |
| 932218 | 7/1963 | United Kingdom . |
| 952112 | 3/1964 | United Kingdom . |
| 1559876 | 1/1980 | United Kingdom . |

*Primary Examiner*—David A. Scherbel
*Assistant Examiner*—Lee Wilson
*Attorney, Agent, or Firm*—Leo Zucker

[57] ABSTRACT

A clamp for clamping a workpiece comprises a base member a clamping member mounted on the base member for linear movement relative thereto and a drive member mounted on the base member for rotary movement relative thereto. First and second cam elements comprising a face cam are provided on the drive member and the base member, at least one of the cam elements including at least two portions of different pitch. The arrangement is such that rotation of the drive member relative to the base member causes linear movement of the clamping member relative to the base member.

12 Claims, 4 Drawing Sheets

CLAMP

BACKGROUND OF THE INVENTION

1. Field of the Invention

The present invention relates to a clamp. In particular, but not exclusively, the invention relates to a clamp for exerting a pushing or pulling force on a workpiece.

2. Discussion of the Known Art

An example of a clamp for exerting a pushing or pulling force on a workpiece is that sold by HMC-Brauer Limited under the model numbers CP1005 to CP1008. This clamp has a roller cam comprising a pair of rollers mounted on spur axles that engage helical tracks provided in the inner cylindrical surface of the clamp body. Rotating a handle causes the rollers to move along the helical tracks, which drives a clamping member in the axial direction of the clamp. The helical tracks include portions of steep and shallow pitch, which allow the clamping member to be brought rapidly into engagement with the workpiece before the clamping force is applied. The clamp is very quick and simple to apply, with a single movement of the handle providing both the initial fast travel of the clamping member and also the final clamping force.

The main problem with the clamp described above is that axles of the roller bearings may shear or be distorted if an excessive force is applied. The nominal maximum holding force of the clamp is therefore only 500 daN, which can easily be applied with a hand impact on the handle. In practice in the workshop, the clamps are often mistreated and a mallet may be used to increase the clamping force. This frequently leads to damage to the clamp.

The above mentioned problem is compounded by the fact that travel of the clamping member is limited by the length of the helical tracks. If the rollers reach the ends of the tracks before a sufficient clamping force has been applied, there will be a temptation to apply the clamp harder as there is no clear indication that the point of maximum travel has been reached. This is again likely to cause damage to the clamp.

A further disadvantage of the clamp is that it is relatively complicated and expensive to manufacture.

SUMMARY OF THE INVENTION

It is an aim of the present invention to provide a clamp that mitigates at least some of the above-mentioned disadvantages.

According the invention, a clamp for clamping a workpiece includes a base member, a drive member mounted on the base member for relative rotational movement about an axis of rotation, and a clamping member mounted on the base member for linear movement in the direction of the axis of rotation. The clamping member has a workpiece engaging portion for engaging a workpiece at a point substantially aligned with the axis of rotation and for exerting a clamping force on the workpiece substantially in the direction of the axis of rotation. The clamp also has a first cam element on the drive member and a second cam element on either the base member or the clamping member for engaging the first cam element. The first and the second cam elements include a face cam, and at least one of the cam elements includes at least two portions of different pitch so that rotation of the drive member relative to the base member produces linear movement of the clamping member relative to the base member in the direction of the axis of rotation.

The use of a face cam rather than roller cams ensures that the cam elements are always in compression, which allows far higher clamping forces to be applied. All clamping elements of the clamp are, in fact, solely in compression during use, and this means that the clamp is extremely robust. The use of a mallet to apply the clamping force is therefore permissible.

Because the cam includes two portions of different pitch, the clamp can provide a fast initial travel followed by a high clamping force. As with the prior art clamp described above, both the initial travel and the clamping force are applied with a single movement of the handle and this makes the clamp very quick and simple to use.

It is possible to form the face cams integrally with the drive member and the handle member or the base member, for example by investment casting. This makes the clamp very simple and inexpensive to manufacture and assemble.

Advantageously, at least one of said cam elements includes a portion of shallow pitch and a portion of steep pitch. Preferably, at least one of said cam elements includes upper and lower portions of shallow pitch and an intermediate portion of steep pitch.

The shallow pitch of the cam surfaces is such that the clamp does not release itself.

The first and second cam elements are advantageously matched substantially to one another. This maximises the contact area of the cam elements, thus reducing friction and minimising wear on the cam surfaces.

The clamp may include a resilient member arranged to resiliently oppose linear movement of said clamping member in a first direction. The resilient member, which may be a spring, may be employed to ensure rapid return of the clamping element when the clamp is released. The resilient member advantageously biases said first and second cam elements towards one another.

The first and second cam elements are advantageously arranged to permit continuous rotation of said drive member in the clamping direction. This prevents the clamp being damaged in an attempt to force the handle beyond a fixed stop. If the handle is rotated beyond the point corresponding to maximum travel of the cam elements, which is indicated by alignment of marks on both the base member and the drive member, the clamp is released and incomplete clamping is indicated audibly and visually.

The cam elements may include stop surfaces to limit rotation of said drive member in a second direction of rotation. This ensures that the handle always returns to the same position when the clamp is released.

The clamp may include means for preventing rotation of the clamping member relative to the base member, thereby preventing damage to the surface of the workpiece.

Alternatively, the clamp may include a lost motion mechanism to allow limited rotational movement of said clamping member relative to said base member. Rotation of the clamping member may be useful for providing additional clearance for insertion or removal of a workpiece. Such a pending British patent application No. 9508951.2, filed Nov. 13, 1996, the contents of which are incorporated herein by reference.

The drive member may include a handle for manual rotation thereof.

Advantageously, the clamping member is arranged to engage the workpiece at a point substantially aligned with the axis of rotation of the drive member and to exert a clamping force on the workpiece substantially in the direction of that axis.

Advantageously, the base member and the drive member comprise metal castings.

An embodiment of the invention will now be described, by way of example, with reference to the accompanying drawings and the applied claims.

BRIEF DESCRIPTION OF THE DRAWING IN THE DRAWING

DETAILED DESCRIPTION OF THE INVENTION

Figure 1:
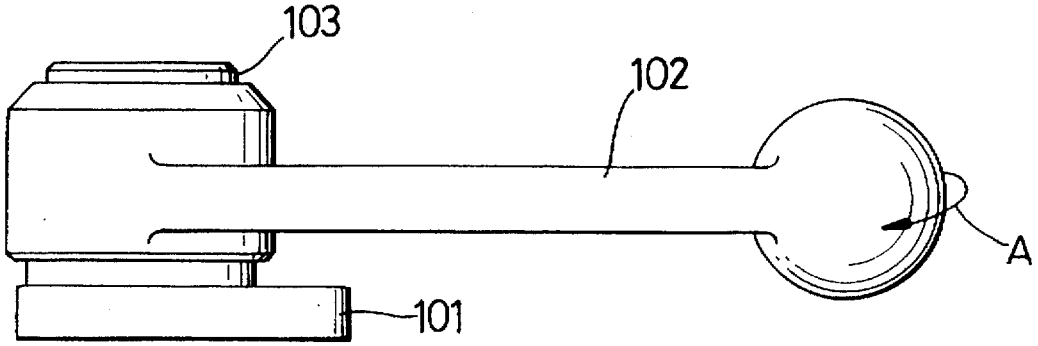
FIG. 1 is a side view of a clamp according the invention.
Figure 2:
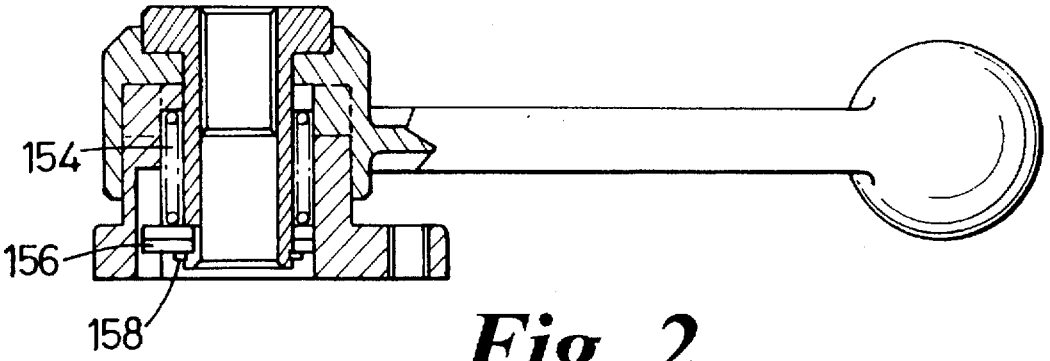
FIG. 2 is a side view of the clamp partly in cross-section.
Figure 3:
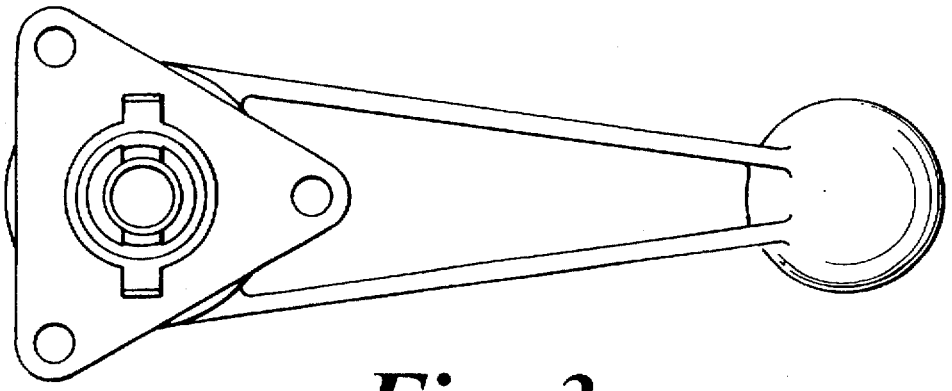
FIG. 3 is a bottom view of the clamp.
Figure 4:
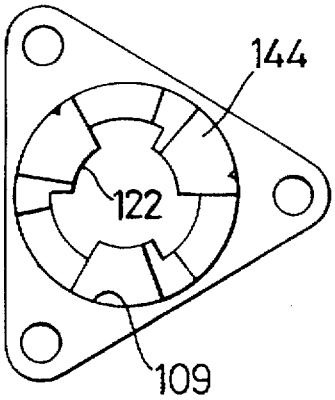
FIG. 4 is a top view of the base.
Figure 5:
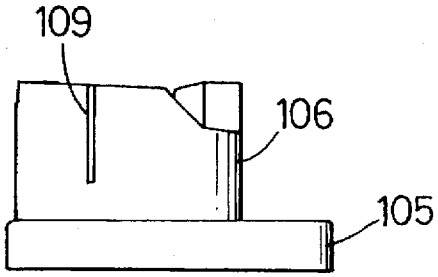
FIG. 5 is a side view of the base.
Figure 7:
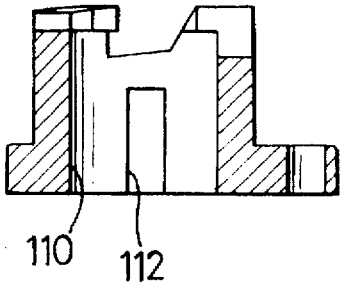
FIG. 7 is a side view of the base in cross-section.
Figure 6:
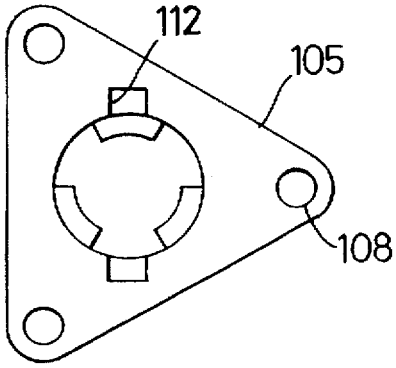
FIG. 6 is a bottom view of the base.

An embodiment of the clamp, which may be described as a cam ram, is shown in FIGS. 1 to 3. The clamp comprises a base 101, a handle 102 and a clamping member 103.

The base 101, which is shown in more detail in FIGS. 4 to 8, comprises a substantially triangular base plate 105 and a substantially cylindrical body member 106 of outside radius $R_0$ that extends perpendicularly to the plane of the base plate 105. Three holes 108 are provided in the base plate 105, one adjacent each corner, which receive bolts for mounting the clamp in use on a work bench or machine tool. Three index marks 109 are provided around the circumference of the body member 106.

A cylindrical bore 110 of radius $R_1$ extends axially through the body member 106. Rectangular recesses 112 that extend from the lower surface of the base 101 to approximately two-thirds its height are formed in opposite sides of the cylindrical wall of the bore 110.

Figure 8:
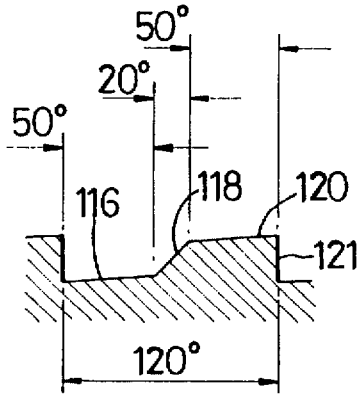
FIG. 8 is a schematic representation of the profile of the base cam surface.
Figure 9:
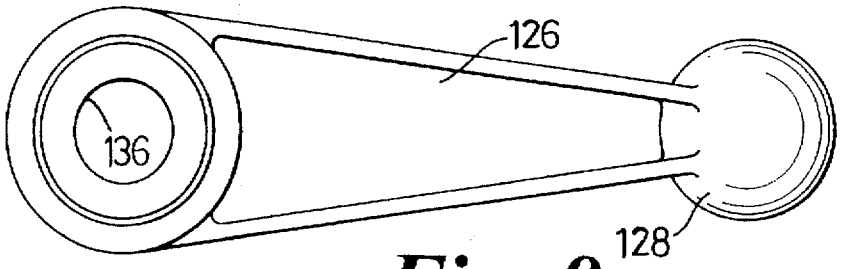
FIG. 9 is a top view of the handle.
Figure 10:
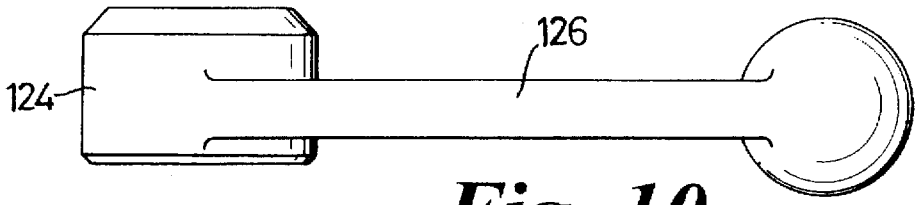
FIG. 10 is a side view of the handle.
Figure 11:
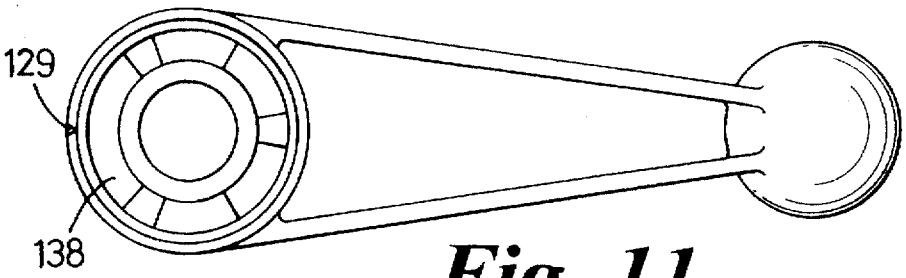
FIG. 11 is a bottom view of the handle.
Figure 12:
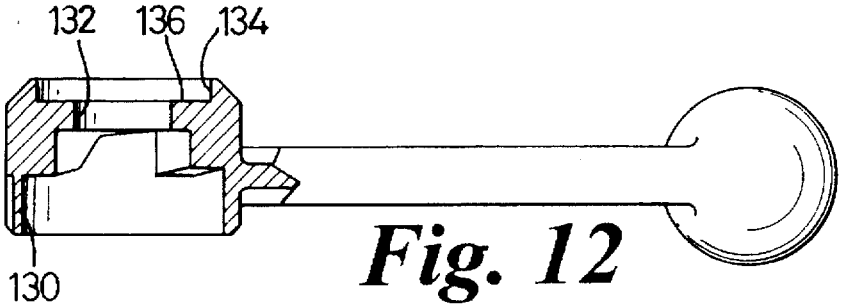
FIG. 12 is a side view of the handle partly in cross section.

The upper face of the cylindrical body member 106 is formed as a cam surface 114. The profile of the cam surface 114 is shown in FIG. 8 and comprises three identical equi-angularly spaced portions, each of which includes a shallow pitch lower section 116, a steep pitch middle section 118 and a shallow pitch upper section 120. In the embodiment shown in the drawings, the lower and upper sections 116, 120 each extend through an arc of approximately 50° and have a pitch at the outside edge of the cam surface producing a rise of 1 mm. The middlesections 118 each extend through an arc of approximately 20° and have a pitch edge producing a rise of 6 mm. The total rise of the cam surface is approximately 8 mm. The ends of adjacent portions of the cam surface 114 are connected by substantially vertical walls that form stop surfaces 121.

The upper sections 120 of the cam surface 114 extend radially inwards, forming lugs 122. The inner edges of the lugs 122 are coincident with an imaginary concentric circle of radius $R_2$ where $R_2<R_1$.

The handle 102, which is shown in more detail in FIGS. 9 to 13, comprises a substantially cylindrical body member 124 and a handle member 126 that extends substantially radially therefrom. The handle member 126 has an H-shaped cross-section and tapers towards its remote end. At the remote end of the handle member 126 there is provided a hand grip 128 in the form of a spherical ball.

The upper and lower edges of the cylindrical handle body member 124 are chamfered, as shown in the drawings. An index mark 129 is provided on the cylindrical surface of the body member 124, at a point displaced at an angle of 180° to the longitudinal axis of the handle member 126.

A cylindrical bore extends through the handle body member 124, the bore comprising a lower portion 130 of radius $R_3$, a middle portion 132 of radius $R_4$ and an upper portion 134 of radius $R_5$, where $R_4=R_2$, $R_3$ is slightly larger than $R_0$ and $R_3<R_5<R_4$. The body member 124 therefore includes an inwardly-extending circular flange 136, defined by the portion of the bore having a radius $R_3$.

Figure 13:
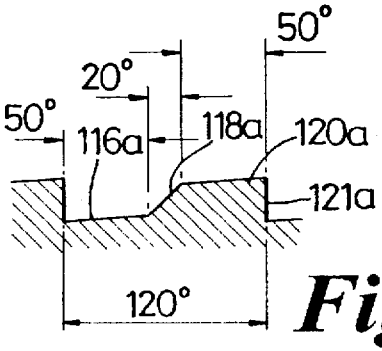
FIG. 13 is a schematic representation of the profile of the handle cam surface.

Provided on the lower surface of the flange 136 is a cam surface 138. The profile of the cam surface 138 is shown in FIG. 13 and is matched to that of the base body member cam surface 114. The cam surface thus comprises three identical equi-angularly spaced portions, each of which includes a shallow pitch lower section 116*a*, a steep pitch middle section 118*a* and a shallow pitch upper section 120*a*. The ends of adjacent portions of the cam surface 138 are connected by substantially vertical walls that form stop surfaces 121*a*. The cam surface 138 extends radially inwards from the cylindrical wall of the lower bore section 130 to a radius $R_6$, where $R_3<R_6<R_4$ and $R_6$ is approximately equal to $R_1$.

The handle 102 is mounted for rotation on base body 101, with the upper part of the base body member 106 extending into the bore lower portion 130. The cam surfaces 114, 138 of the body member 106 and the handle 102 engage one another.

Figure 14:
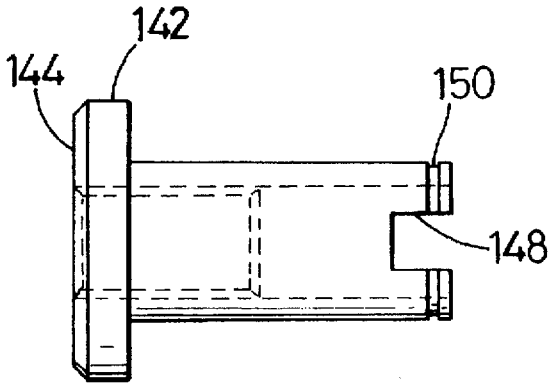
FIG. 14 is a side view of the clamping member.
Figure 16:
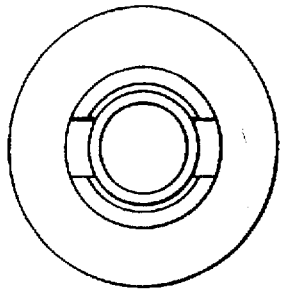
FIG. 16 is a bottom view of the clamping member.
Figure 15:
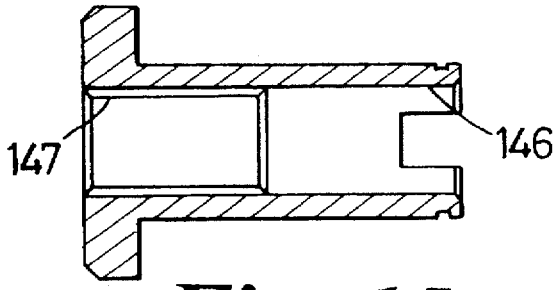
FIG. 15 is a side view of the clamping member in cross section.

The clamping member 103, which is shown in more detail in FIGS. 14 to 16, comprises a substantially cylindrical body member 140 of radius $R_7$ and a circular disc 142 of radius $R_5$ and $R_7$ is slightly less than $R_4$. The upper edge of the disc 142 is chamfered and the upper face 144 of that disc forms the work engaging face of the clamp.

A plain cylindrical bore 146 of radius $R_9$ extends axially through the body member 140 and the disc 142. Optionally, the bore 146 may be provided with a screw thread 147 to permit a force transmitting rod or an alternative work engaging face (neither shown) to be attached to the clamp. At the lower end of the body member 140 there are provided two rectangular cut outs 148. A peripheral groove 150 is formed in the cylindrical wall of the body member 140, adjacent its lower end.

A compression spring 154 is seated within the base bore lower portion 106 and abuts at its upper end the lower surfaces of the lugs 122. The lower end of the spring engages a pair of washers 156 that surround the lower end of the clamping member 103 and are held in position by a circlip 158 that engages the peripheral groove 150.

Figure 17:
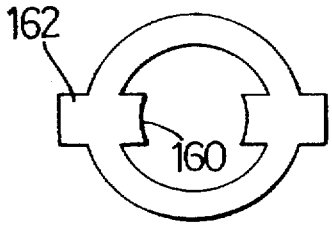
FIG. 17 is a bottom view of the washer.

Each washer 156, shown in more detail in FIG. 17, includes two pairs of radially inwards- and outwards-extending tabs 160, 162 that engage respectively the cut outs 148 of the clamping member 103 and the rectangular recesses 112 of the base 101. This prevents rotation of the clamping member 103 with respect to the base 101 but allows linear axial relative movement thereof. The spring 154 serves to bias the clamping member 103 axially downwards (i.e. towards the base plate 105).

The base 101 and the handle 102 are manufactured from alloy steel, for example nickel carbon steel, by investment casting (e.g. by lost was casting). Precision casting techniques are employed, providing tolerances of ±0.005" per inch (±0.12 mm per 25 mm). This precision allows the parts to be assembled with almost no machining. The castings are case hardened to provide a high surface hardness for the cams and a tough core for compressive strength. The castings are finished with manganese phosphate, which provides corrosion resistance. The clamping member 103 is machined from carbon nickel alloy barstock.

Operation of the clamp will now be described with reference to FIGS. 1 to 3. In the rest position as shown in those drawings, the cam surfaces 114, 138 are held in full mating engagement by the biassing force of the spring 154. In this position, the clamping member 103 is clear of the workpiece, which allows the workpiece to be placed in position.

As the handle is rotated in the direction of the arrow A (clockwise when seen from above), the mutual engagement of the steep pitch middle portions 118, 118*a* of the cam surfaces 114, 138 causes the clamping member 103 to rise rapidly into a position where it is nearly in engagement with the workpiece. In the embodiment, a fast rise of 6.0 mm is provided.

When the handle has rotated through an angle of approximately 20°, the steep pitch middle portions 118, 118*a* reach the end of their travel and the lower cam sections 116*a* of the handle 102 come into engagement with the upper cam sections 120 of the base 101. These cam sections have a shallow pitch and it is therefore possible to apply a large clamping force to the workpiece by rotation of the handle 102. In the embodiment, the handle may be rotated through a further 100°, producing a clamping rise of 2.0 mm. Throughout both fast and clamping travel of the clamping member, rotation of the clamping member is prevented, so avoiding damage to the surface of the workpiece. The limits of the fast and clamping travel movements are indicated by alignment of the index marks 109, 129 on the base 101 and the handle 102.

In order to release the clamp, the handle 102 is rotated back in the anti-clockwise direction until the cam surfaces 114, 138 are once again in full mutual engagement. Further anti-clockwise rotation of the handle beyond this point is prevented by the engagement of the substantially vertical stop surfaces 121, 121*a*. The clamping member 103 is driven back to its rest position under the biassing force of the spring 154.

The clamping force exerted on the workpiece is, of course, dependent on the force applied to the handle 102. The clamp is designed to be able to withstand the use of a mallet to apply and release the clamp.

If the clamp is over tightened, there is a possibility that the cam surfaces may be left at the very limit of their travel. Such a situation is potentially dangerous since it is possible that cams could slip over onto the next surface, thereby releasing the clamp.

In order to reduce this danger, the limit of acceptable tightening is indicated by alignment of the index marks 109, 129 on the base 101 and the handle 102. If the handle is rotated in the clockwise direction through more than 120° from the rest position, the lower cam sections 116*a* of the handle 102 will slip off the ends of the upper cam sections 120 of the base 101 and the clamping member will be driven back to the rest position by the spring 154. This produces an audible clicking noise, which warns the operator that the clamp has not been successfully applied.

As will be apparent from the above description, the clamp can be applied and released with only single movements of the handle 102. The clamp is therefore very quick and easy to use. The clamp is also capable of applying very high clamping forces, since all the force transmitting parts of the clamp are in compression.

Various modifications of the clamp are envisaged. For example, the slope of the cam sections may be reversed, so that clamping is produced by anti-clockwise rather than clockwise rotation of the handle 102, and the mutually engaging cam surfaces 114, 138 may be provided on the handle 102 and the clamping member 103, instead of the base 101 and the handle 102. Further, by providing a connecting rod that is attached to the clamping member 103 and extends downwards through the bore 146 and out through the base plate 105, the clamp may be used to provide a pulling force rather than a pushing force. Alternatively, a pulling force may be provided by switching the relative positions of the handle 102 and the clamping member 103. If the clamping member is provided with a radially-extending arm, the clamp may be employed as a down-thrust clamp.

Whilst the profile of the cam surfaces 140, 172 that is described above is preferred, it is envisaged that the cam surfaces may take other forms: for example, the pitches and lengths of the steep pitch and shallow pitch sections may be varied. It is, however, important that the pitch of the shallow pitch sections is large enough to produce sufficient axial travel, whilst being small enough to product the required clamping force and to prevent the clamp releasing itself.

Although it is preferred that the two cam surfaces should be matched to one another, this is not essential. Instead, a cam and cam follower arrangement could be provided.

I claim:

1. A clamp for clamping a workpiece, the clamp comprising a base member, a drive member mounted on the base member for rotary movement relative thereto about an axis of rotation, a clamping member mounted on the base member for linear movement relative thereto in the direction of said axis of rotation, at lest one engaging element having parts fitted in corresponding portions of the clamping member and the base member, wherein the engaging element is constructed and arranged to prevent relative rotation between the clamping and the base members while permitting said linear movement, said clamping member having a workpiece engaging portion for engaging a workpiece at a point substantially aligned with said axis of rotation and exerting a clamping force on the workpiece substantially in the direction of said axis of rotation, a first cam element provided on the drive member and a second cam element provided on either the base member or the clamping member and engaging the first cam element, said first and said second cam elements comprising a face cam, at least one of said cam elements including at least two portions of different pitch, wherein rotation of the drive member relative to the base member causes linear movement of the clamping member relative to the base member in the direction of said axis rotation.

2. A clamp according to claim 1, in which at least one of said cam elements includes a portion of shallow pitch and a portion of steep pitch.

3. A clamp according to claim 2, in which at least one of said cam elements includes upper and lower portions of shallow pitch and an intermediate portion of steep pitch.

4. A clamp according to claim 1, in which the first and second cam elements are matched substantially to one another.

5. A clamp according to claim 1, including a resilient member arranged to resiliently oppose linear movement of said clamping member in a first direction.

6. A clamp according to claim 5, wherein said resilient member biases said first and second cam elements towards one another.

7. A clamp according to claim 1, wherein said first and second cam elements are arranged to permit continuous rotation of said drive member in a first direction of rotation.

8. A clamp according to claim 1, wherein said cam elements include stop surfaces to limit rotation of said drive member in a second direction of rotation.

9. A clamp according to claim 1, including means for preventing rotation of the clamping member relative to the base member.

10. A clamp according to claim 1, including a lost motion mechanism to allow limited rotational movement of said clamping member relative to said base member.

11. A clamp according to claim 1, wherein said drive member includes a handle for manual rotation thereof.

12. A clamp according to claim 1, wherein the base member and the drive member comprise metal castings.

* * * * *